US006049956A

United States Patent [19]

Lifke et al.

[11] Patent Number: 6,049,956

[45] Date of Patent: Apr. 18, 2000

[54] METHOD AND APPARATUS FOR SPREADING FIBER BUNDLES

[75] Inventors: Joseph Lee Lifke; Lincoln Drake Busselle; Dana Jesse Finley, all of Albuquerque; Brent William Gordon, Rio Rancho, all of N. Mex.

[73] Assignee: Adherent Technologies, Inc., Albuquerque, N. Mex.

[21] Appl. No.: 09/336,526

[22] Filed: Jun. 18, 1999

[51] Int. Cl.[7] ..... D01D 11/02

[52] U.S. Cl. ..... 28/282; 19/65 T

[58] Field of Search ..... 28/282, 283, 240, 28/212, 247, 248, 268, 220; 19/65 T, 66 T; 26/71, 87

[56] References Cited

U.S. PATENT DOCUMENTS

| | | | |
|---|---|---|---|
| 1,189,873 | 7/1916 | Rooney | 26/87 |
| 1,716,555 | 6/1929 | Kane | 26/99 |
| 2,856,060 | 10/1958 | Malnati | 26/87 |
| 2,986,844 | 6/1961 | Lane, Jr. | 26/87 |
| 3,303,547 | 2/1967 | Kalwaites | 26/87 |
| 3,456,156 | 7/1969 | Kilby . | |
| 3,669,552 | 6/1972 | Briscoe | 26/28 |
| 3,704,485 | 12/1972 | Hall . | |
| 3,795,944 | 3/1974 | Daniels . | |
| 3,808,639 | 5/1974 | Tautvaisas | 26/87 |
| 3,840,941 | 10/1974 | Neven | 28/282 |
| 3,873,389 | 3/1975 | Daniels . | |
| 3,967,118 | 6/1976 | Sternberg . | |
| 4,081,856 | 3/1978 | Sternberg . | |
| 4,120,079 | 10/1978 | Yamaguchi et al. | 28/282 |
| 4,301,579 | 11/1981 | Van Den Hoven | 28/282 |
| 4,799,985 | 1/1989 | McMahon et al. . | |
| 4,994,303 | 2/1991 | Calkins . | |
| 4,999,733 | 3/1991 | Kakuda . | |
| 5,042,111 | 8/1991 | Iyer et al. . | |
| 5,042,122 | 8/1991 | Iyer et al. . | |
| 5,057,338 | 10/1991 | Baucom et al. . | |
| 5,094,883 | 3/1992 | Muzzy et al. . | |
| 5,101,542 | 4/1992 | Nakagawa et al. . | |
| 5,128,199 | 7/1992 | Iyer et al. . | |
| 5,200,620 | 4/1993 | Peritt et al. . | |

FOREIGN PATENT DOCUMENTS

| | | | |
|---|---|---|---|
| 46-40496 | 11/1971 | Japan | 28/282 |

*Primary Examiner*—Amy B. Vanatta
*Attorney, Agent, or Firm*—Rod D. Baker

[57] ABSTRACT

A system for spreading a multi-filament bundle of fibers such that most of the individual fibers are exposed for various treatment and coating processes is described. The system is particularly suited to, but not limited to, carbon fiber applications. In such applications it is desired to spread carbon fiber tows consisting of anywhere from less than 1,000 to in excess of 144,000 individual filaments such that a significant portion of the filaments are exposed for processing. A spreading system can consist of one or more individual spreaders placed in series to achieve a desired spread. Each spreader consists of expandable bands, an expandable tube, or a compressible and expandable piece of foam placed between two angled support discs. The discs are angled away from each other such that the bands, tube, or foam between the closest points of the angled discs will stretch or expand as the support discs rotate about their respective axes. The fiber bundle enters the spreader at the point where the discs are closest together and exits at the point where the discs are furthest apart. The bands, tube, or foam therefore support the incoming fiber bundle and stretch or expand to an established width, thereby separating a portion of the individual filaments. Changing the angle of the support discs can control the amount of stretch. As the angle is increased, the overall stretch or expansion that the bands, tube, or foam are subjected to will increase, thereby increasing the filament separation of the fiber bundle. One or more spreaders can be placed in series to obtain a desired spread beyond the capabilities of a single spreader. The spreaders can be free spinning or motor driven depending upon the application.

28 Claims, 9 Drawing Sheets

METHOD AND APPARATUS FOR SPREADING FIBER BUNDLES

BACKGROUND OF THE INVENTION

1. Field of the Invention (Technical Field)

The present invention relates to a system for spreading a multi-filament bundle of fibers into individual fiber strands, particularly for spreading the bundle into individual strands for various subsequent treatments and coating processes. The invention is particularly well suited for various carbon fiber applications, including prepreg processing, and can operate over a wide range of fiber speeds and bundle spread range.

2. Background Art

Many industrially useful fibers are manufactured, or transported, or stored, in collective bundles. A number of industrial and manufacturing processes require that a bundle of fibers be spread to expose the exterior surfaces of the individual fibers. Commonly in such processes, it is needful to separate a bundle or "tow" of collected fibers into individual fibers so that the individual fibers can be subjected to further processing, for example to be coated with a substance, incorporated into a composite component, and the like.

Various methods have been developed for spreading fiber bundles into their constituent strands. Known methods typically involve vibration, pneumatics, the use of rigid barrel-shaped rollers, or electrostatic charging of the fiber bundle.

In U.S. Pat. No. 5,101,542, for example, a fiber separator includes a separating roller composed of a plurality of bulged, barrel-shaped rollers having their respective axes arranged in a circle. The rollers force the fiber bundle to separate into individual fibers at a rigid bulged surface in such a manner that the fiber bundle is flattened along the bulged surface. It is indicated that the running speed of the fiber bundle is slow, thus limiting the utility of the spreader to applications tolerating relatively slow process speeds. Also, it is likely that such a system could damage delicate fiber bundles.

U.S. Pat. No. 3,704,485 describes a method and apparatus for spreading a tow of fibers using a speaker or other gas vibrator adjacent to the fibers. The tow of fibers passes over the speaker under low tension, and is spread by the sound waves created by the speaker. With this method, the tow of fibers is unrestrained and can be damaged. Furthermore, controlling the fiber spacing within the spread fiber bundle is difficult.

The device described in U.S. Pat. No. 5,042,111 appears to operate on the principle that a pulsating flow of energy in a gaseous medium spreads a collimated fiber tow into its individual filaments. The source of energy is a vibrating cone or diaphragm of a speaker, or other vibrator, which oscillates at a predetermined frequency and amplitude. The acoustic energy provided by the speaker enables the fiber tow to spread.

Cited examples in U.S. Pat. No. 5,042,111 do not indicate speeds greater than 3 cm/sec (5.9 ft/min). A similar spreader, discussed in U.S. Pat. No. 5,128,199, and having the same inventors as U.S. Pat. No. 5,042,111 also uses acoustic vibration, preferably an acoustic speaker.

U.S. Pat. No. 4,994,303 describes a method of spreading yarn fibers with spreader bars. The spreader bars change the cross-sectional configuration of the yam from a tightly bundled and compressed round shape to a flat, ribbon-like configuration. The yarn fibers are drawn over and under the spreader bars at sharp angles under tension. This system is likely to damage delicate fiber bundles such as un-sized carbon fiber. The method also does not appear to have the ability to control the spread width.

Described in U.S. Pat. No. 4,799,985 is a gas banding jet for spreading fiber tows. The banding jet consists of a gas box into which compressed air or another gas is fed through an adjustable gas metering means. One, or more than one, gas exit ports are provided to cause gas from within the gas box to impinge in a generally perpendicular fashion upon the fiber tow that passes across the exit ports.

U.S. Pat. No. 4,799,985 teaches a fiber comb having a plurality of spaced-apart fingers that act to separately maintain the various fine yams of a thermoplastic polymeric fibers, while U.S. Pat. No. 5,057,338 describes a method for spreading filamentary material using vacuum pressure.

U.S. Pat. No. 3,795,944 discloses a process and apparatus for pneumatically spreading thin graphite or other carbon filaments from a tow bundle to form a sheet or tape in which the filaments are maintained parallel. The process includes passing the tow through at least one slot venturi spreader in which the tow is pulled through the spreader in a direction opposite the primary air flow through the venturi. A process that operates on the same general principle is described in U.S. Pat. No. 3,873,389 which is a division of application Ser. No. 205,878, filed Dec. 8, 1971, now U.S. Pat. No. 3,795,944.

Using air, vacuum, or a pressurized gas to separate fiber bundles has limitations, and is not well suited for delicate fibers, particularly when operating at relatively high speeds. Adjustment and control of the spread width with such devices can be difficult.

U.S. Pat. No. 5,094,883 discusses a method of spreading towpregs whereby a tow is first woven through a series of three cylindrical rollers, to impart a constant tension on and to reduce the vibration of the tow filaments. The tow then enters an air comb where forced air further spreads the filaments.

U.S. Pat. No. 5,200,620, describes a fiber spreader that includes a thin electrically grounded support sheet for supporting a layer of fibers on one surface thereof. The fibers supported on the support sheet are guided by a plurality of guide rollers past a corona discharge region, where the fibers are spread electrostatically. Although speed limitations of the corona discharge device are not discussed in U.S. Pat. No. 5,200,620 it is anticipated that maintaining a desired spread at high speeds would be very difficult to achieve. Other corona discharge devices are described in U.S. Pat. No. 4,081,856, U.S. Pat. No. 3,967,118, U.S. Pat. No. 3,456,156 and U.S. Pat. No. 4,999,733.

Against the foregoing background, the present invention was developed. The inventive apparatus and process provide an alternative means and method for spreading multi-filament bundles of fibers without the need for pneumatics, vacuum pressure, electrical charge, vibration, or specially shaped rigid rollers, such as crowned or barrel rollers. The invention imparts minimal damage to the fibers, thereby allowing its use with delicate fibers. The inventive spreader is adjustable, which allows for good control of the spread width, and can operate from very low speeds (i.e. fiber bundle speeds less than 10 ft/min) to high speeds (i.e. fiber bundle speeds in excess of 300 ft/min). Several spreaders can be placed in series to achieve a spread that is many times the incoming width for the manufacture of thin, low areal density composite tapes.

SUMMARY OF THE INVENTION (DISCLOSURE OF THE INVENTION)

The primary object of the present invention is to provide a method and apparatus for spreading a multi-filament bundle of fibers to expose a majority of the individual fibers, particularly as the bundle moves toward a subsequent treatment and/or coating process or processes. The fibers can include, but are not limited to, inorganic, metallic, ceramic, organic, and refractories. Typical fiber compositions include carbon, glass, quartz, polymerics, silicon carbide, and boron nitride. Basically, any continuous fiber bundle having individual strands, filaments, or fibers that are separable can be used with the present invention. In this disclosure, "strand," "fiber," and "filament" are used essentially interchangeably to refer to an individual component, and a contiguous collection of such components is referred to as a "tow" or "bundle".

A primary advantage of the invention is the provision of a means for efficiently spreading a multi-filament bundle of fibers without causing unacceptable damage to the fibers, and without the need for pneumatics, vacuum pressure, electrical charge, vibration, or other complex processes or mechanisms. Moreover, the inventive spreader is adjustable, which allows for control of the spread width. Two or more spreaders can be placed in operational series to obtain a cumulative effect, resulting in a spread of fibers many times the original or incoming width. Use of a series of inventive apparatuses achieves a wide, low areal density fiber spread for use in, for example, fiber reinforced tapes. The inventive spreader can run from very low speeds (i.e. fiber bundle speeds less than 10 ft/min) to high speeds (i.e. fiber bundle speeds in excess of 300 ft/min).

There is provided according to the invention an apparatus for spreading the individual fibers of a fiber bundle, comprising at least one elastically expandable member rotatably mounted upon a support, and means for periodically expanding and contracting a portion of the elastically expandable member; wherein when the fiber bundle is frictionally wrapped at least partially around the elastically expandable member to engage the portion, and when the member is rotated, individual fibers of the bundle are spread by the expansion of the portion of the expandable member. In one embodiment of the invention, at least two inventive apparatus are disposed in parallel, wherein the bundle is wrapped at least partially around at least two elastically expandable members, and when the members are rotated, the bundle moves serially through the two apparatuses.

The inventive apparatus preferably includes a pair of support discs, one of each the discs attached to a respective end of the expandable member, and preferably the support discs are disposed at an oblique angle so that the distance separating the discs varies, and wherein the rotation of the discs alternately increases and decreases the separation distance between a point on the periphery of one of the discs and the corresponding point on the periphery of the other disc. Also, the discs most preferably are substantially circular, and the elastically expandable member defines a generally cylindrical shape, although alternative embodiments may incorporate an expandable member or discs having a polygonal cross-section, such as a hexagon or octagon. The elastically expandable member preferably comprises a plurality of elastic bands, which most preferably are uniformly spaced apart and disposed between the peripheries of the support discs. Alternatively, the elastically expandable member comprises an elastic tube, and may include a fitting in one of the support discs for adjusting gas pressure within the elastic tube. Also, an expandable and compressible foam insert may be disposed within the elastic tube. In still one other alternative embodiment the elastically expandable member comprises an elastically expandable foam insert.

Preferably, there is provided means for controllably adjusting the oblique angle, and means for adjusting the absolute distance separating the discs. Also, there may be provided an integrally powered embodiment of the apparatus having means for powered rotation of at least one of the discs.

The invention also includes a method for spreading the individual fibers of a fiber bundle, comprising the steps of frictionally wrapping the fiber bundle at least partially around at least one elastically expandable member to engage the portion of the member, rotating the elastically expandable member, and periodically expanding and contracting a portion of the elastically expandable member, wherein when the member is rotated, individual fibers of the bundle are spread by the expansion of the portion of the expandable member. The inventive method may further comprise the steps of attaching a support disc to each end of the expandable member, and disposing the discs at an oblique angle so that the distance separating the discs varies, and wherein rotating the expandable member alternately increases and decreases the separation distance between a point on a periphery of one of the discs and the periphery of the other disc. In the method, the step of rotating the elastically expandable member comprises disposing in a cylindrical array a plurality of elastic bands, and rotating the cylindrical array generally about its axis.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

Figure 1:
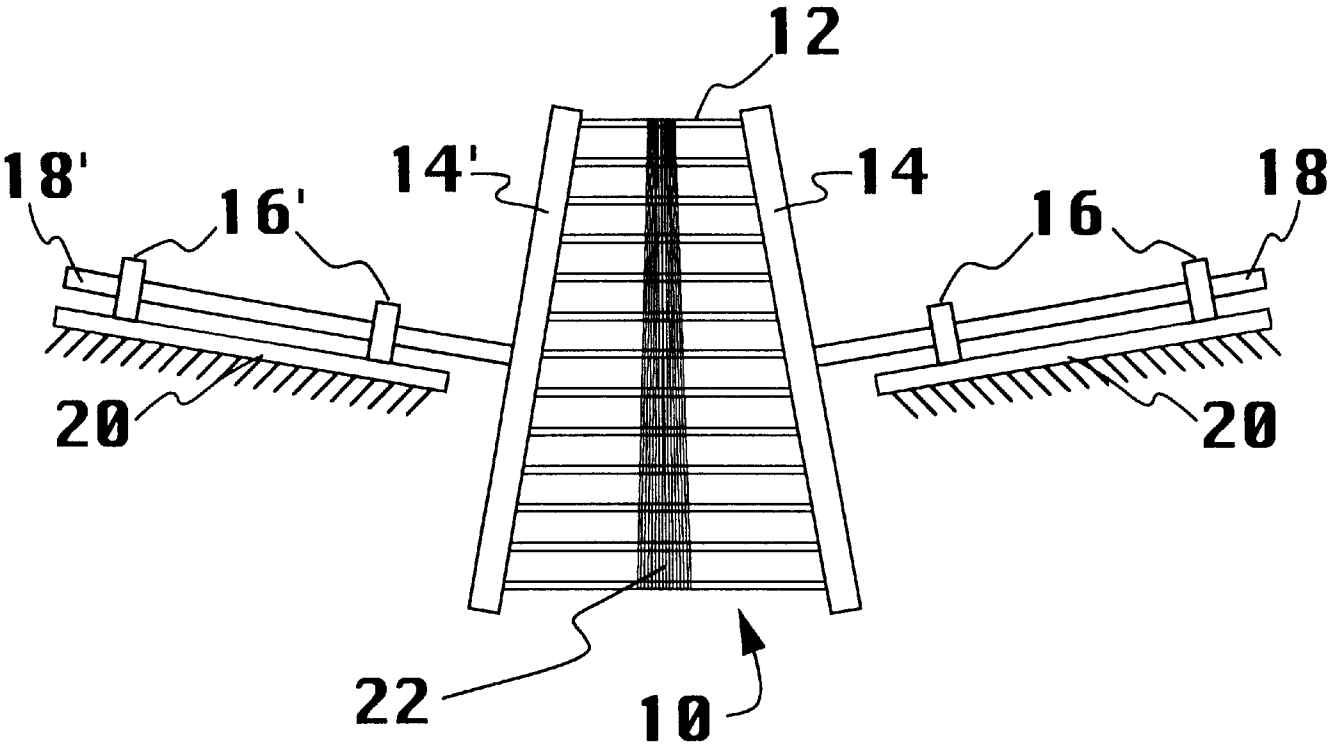
FIG. 1 is a front view of one embodiment of the spreader apparatus according to the invention, showing expandable bands as the elastically expandable member of the apparatus, and the fiber bundle entering at the top and exiting at the bottom of the figure.

DESCRIPTION OF THE PREFERRED EMBODIMENTS (BEST MODES FOR CARRYING OUT THE INVENTION)

The invention provides a means and method for spreading a fiber bundle to various widths to expose a majority of the individual filaments.

The invention is particularly suited to, but not limited to, carbon fiber applications. In such applications, it is desired to spread carbon fiber tows consisting of anywhere from less than 1,000 to in excess of 144,000 individual filaments such that a significant portion of the filaments are exposed for processing. An apparatus according to the invention may include one or more individual spreaders placed in series to achieve a desired degree of spread. Each inventive spreader consists of expandable bands, an expandable tube, or a compressible and expandable piece of foam placed between two angled support discs. In this disclosure, "expandable" means generally the mechanical characteristic of a material that is capable of significant elastic deformation, expansion as well as elastic contraction or compression from an expanded condition. The discs are angled away from each other such that the bands, tube, or foam insert between the closest points of the angled discs will stretch or expand as the support discs rotate about their respective axes. The fiber bundle enters the spreader at the point where the discs are closest together and exits at some later point—typically at or before the point where the discs are furthest apart.

Thus, according to the invention, a tow of fibers (for example a collection of hundreds or more of individual, small-diameter fibers gathered together to form a generally cylindrical cord-like flexible bundle), is manipulated to spread the individual fibers. By the invention, the individual fibers are separated for various subsequent processing, or to define a flatter, tape-like bundle. In distinction from known fiber spreader systems, the present invention does not rely upon pressurized air, vacuum, acoustic vibration, grooved or crowned rollers, or electrostatic charge to achieve the spread. Rather, it utilizes an elastically expandable member, such as elastically expandable bands uniformly disposed between the peripheral edges of two discs, or alternatively an elastically expandable tube or an elastically expandable piece (e.g. cylindrically shaped insert) of foam disposed and supported between two discs. The discs very preferably are disposed mutually non-parallel, or obliquely, with respect to each other. The imaginary lines defining the respective axes of rotation of the discs therefore preferably are coplanar, but are not parallel or collinear.

Accordingly, as the discs are rotated, any given portion of the elastically expandable member (i.e., the bands, or the outside surface of the tube or foam insert), alternatively stretches and contracts. In the case of the bands, any individual band, being a portion of the total elastically expandable member, periodically expands and contracts. In embodiments incorporating a tube or insert, arcuate or radial portions of the tube or insert periodically expand and contract. The repeated stretching and contacting action of the bands (or tube, or foam insert) acts to divide and spread the fibers as they wrap and pass around the revolving bands or rotating tube or foam insert. In this disclosure and in the claims, "wrap" refers to the contact between the bundle and the rotating elastically expandable member which typically, but not necessarily, is a contact over about 180° (i.e. about half) of the periphery of the expandable member. This is not critical, however, and the fiber bundle may wrap around less than half, or even one-quarter (i.e. 90°) or less of the expandable member's periphery.

Figure 2:
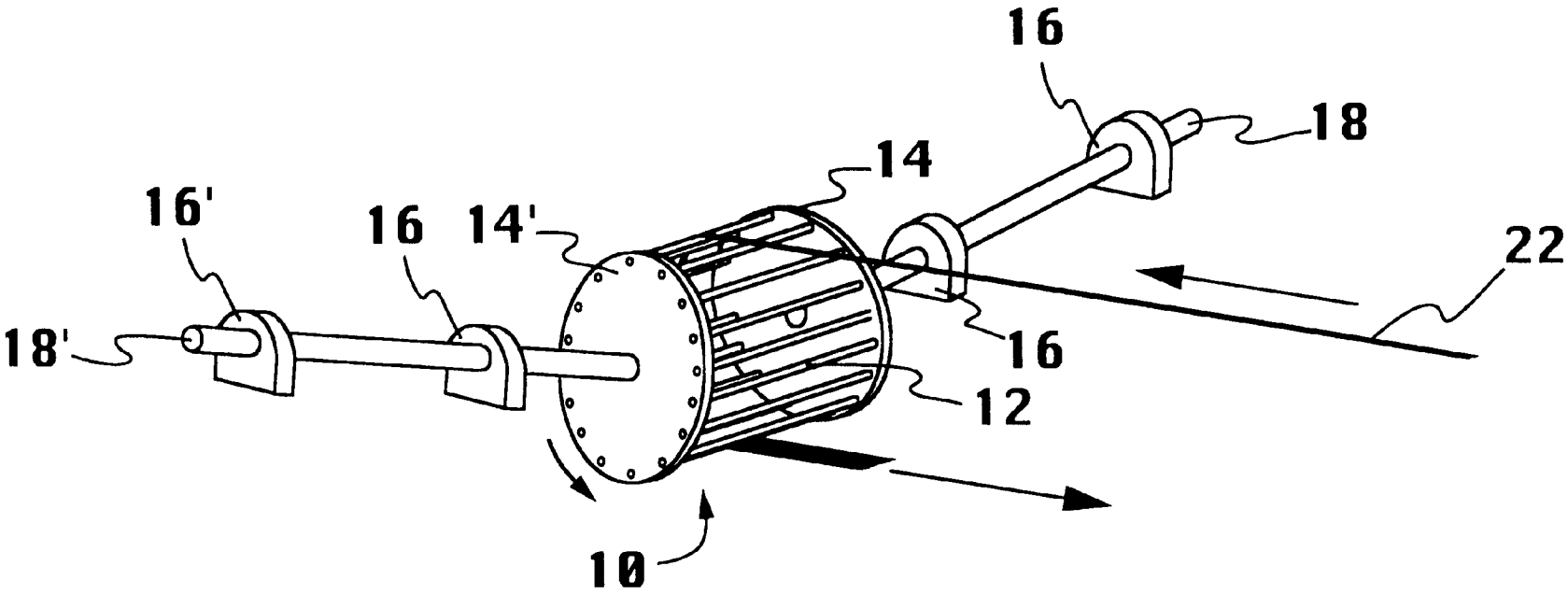
FIG. 2 is an isometric view of the embodiment shown in FIG. 1, showing the fiber bundle entering and exiting the inventive apparatus.

Combined reference is made to FIGS. 1 and 2. The fiber spreader, which is generally denoted by 10, includes an elastically expandable member disposed between and supported by two support discs 14, 14'. The expandable member preferably is a plurality of uniformly arranged expandable bands 12 as shown in FIGS. 1 and 2. The invention preferably thus includes a plurality of elastically expandable bands 12 supported by and between a pair of rigid support discs 14, 14'. The discs 14, 14' are connected to respective shafts 18, 18', which in turn are rotatably supported upon corresponding bearings 16, 16'. Accordingly, the support discs 14, 14' are free to rotate with respect to a support structure 20 to which the bearings 16, 16' are attached.

As illustrated by FIGS. 1 and 2, the discs 14, 14' in the preferred embodiment are not parallel. Rather, the discs 14, 14' are non-parallel, or mutually oblique. Disposing the shafts 18, 18' as seen in FIG. 1 in a non-collinear and non-parallel arrangement preferably provides this disposition, as seen in FIG. 1. However, the discs 14, 14' are disposed normally upon the shafts, i.e. the shafts 18, 18' preferably are secured perpendicular to the planes of the discs, at the geometric center of the discs 14, 14'. While in the preferred embodiment the discs 14, 14' are circular, the scope of the invention extends to alternative embodiments employing non-circular support discs; for example, in alternative embodiments the discs 14, 14' may be polygonal or ellipsoid. Generally, however, the discs 14, 14' are shaped substantially identical to each other to form a matching pair. Accordingly, and as suggested by the figures, the apparatus of the invention is bilaterally symmetrical about an imaginary mid-plane located between the two discs 14,14'.

As best seen in FIG. 2, the elastically stretchable bands 12 are attached circumferentially about the periphery of each of the discs 14, 14' and extend from the inside periphery of one disc 14 to the inside periphery of the other disc 14'. Opposite ends of each band 12 are attached to corresponding inside faces of each of the discs 14, 14'. The bands may be attached in any suitable manner; in one embodiment, it is preferred that the bands be attached by means of a pivot or ball-and-socket type joint to reduce repeated flexural stresses in the band in the immediate vicinity of its point of attachment to a disc. The elastically expandable bands 12 are approximately parallel to each other and generally uniformly spaced, that is, their respective points of attachment to the discs 14, 14' preferably are equidistantly spaced. Each band 12 is pre-stretched prior to attachment to the discs 14, 14', so that it is constantly in a state of tension during operation of the invention (although the degree of tension varies during operation, as each band is further stretched and then allowed to contract). Bands in diametrically opposite positions upon the discs 14, 14' have, at any given time, essentially offsetting force effects upon the discs. Accordingly, the engagement of a moving bundle 22 with the bands 12 permits the entire expandable member component (the plurality of bands) of the spreader, together with the discs 14, 14' to spin freely upon the shafts 18, 18'.

The bands 12 are made from nearly any elastically expandable material, including rubbers and elastomers. Alternatively, each band 12 may be composed of an individual helical spring covered with an elastic sheath.

The skewed arrangement of the shafts 18, 18', with the discs 14, 14' disposed perpendicularly upon corresponding shafts, orients the discs in the oblique relationship best viewed in FIG. 1. There it is observed that the tops of the discs 14, 14' are closer together than the bottoms. The discs 14, 14' rotate at a common speed, so that the rotational velocity of their respective peripheries are equal. Accordingly, any pair of points in confronting aligned relationship upon respective inside faces of the discs 14, 14' remain constantly aligned. (That is, as viewed in FIG. 1, an imaginary line segment extending between associated aligned pairs of points remains generally horizontal, but varies in length, as the discs 14, 14' rotate upon the inclined shafts 18, 18'.) As the discs rotate, the distance between any pair of corresponding confronting points (except the pair of points defining the centers—at the axes of rotation—of the discs 14, 14') varies. Points upon the faces of the discs 14, 14' revolve around the skewed axes of rotation, with the result that associated pairs of aligned points are closest together when at the "top" of the rotation (FIG. 1) and are furthest apart when at the "bottom." Thus, since the support discs are disposed at an oblique angle so that the distance separating the discs varies, the rotation of the discs alternately increases and decreases the separation distance between a point on a periphery of one of the discs and the periphery of the other disc.

Consequently, the elastically stretchable bands 12 periodically expand and contract as the discs 14, 14' rotate, with the result that the lengths of the bands 12 are constantly changing. The bands are stretched to maximum extended length when moved into position at the bottom of the arrangement shown in FIG. 1, and then elastically contract while approaching the uppermost top position. (It will be immediately apparent that, while the preferred embodiment of the invention is arranged in space as seen in FIG. 1, this is not critical. The invention can be rotated to any position about the line connecting the centers of the discs 14, 14' without disturbing the operation of the invention. The fiber bundle 22 can, therefore, enter the spreader and contact the expandable member at some angle other than horizontal. Likewise, the spread filaments can depart from the spreader at nearly any angle. Alternatively, the entire spreader apparatus 10 could be rotated ninety degrees to place the discs 14, 14' almost horizontal and the shafts 18 ,18' just off the vertical. Nevertheless, optimum performance is realized when the bundle 22 to be separated is contained generally within a substantially vertical plane, as suggested by FIG. 1.)

The elastic stretching and contracting of the bands 12 is according to an approximately sinusoidal function, the bands alternately gradually expanding to a maximum extension, and then gradually contracting back to a minimum extension. If, as in the preferred embodiment, the bands 12, 12' attached at the peripheries of the discs 14, 14', the maximum extension of any given band is about equal to the maximum distance separating the discs, and the minimum extended length is about equal to the minimum distance between the discs.

In alternative embodiments, a supporting structure, such as a comparatively rigid support (for example, a large section of polyvinyl chloride pipe or the like), or a foam insert as described hereinafter, is placed within the plurality of bands 12. Such a supporting insert, shaped to conform to the cross sectional shape (e.g. cylinder) defined by the plurality of bands 12, provides interior radial support to the bands to limit the radially inward lateral displacement of the bands under the force of the fiber bundle 22. The support encourages axial stretching of the bands 12 instead of lateral displacement, thus improving the efficiency of the spreader.

An advantage of the invention is that the band spacing, band quantities, and band lengths may be varied to accommodate the desired spread and fiber bundle speed. By varying the number of bands and the spacing of the bands about the peripheries of the discs, the absolute rate of spreading can be manipulated to accommodate the characteristics of the particular bundle being processed. A relatively larger number of bands closely spaced can impart a significant degree of fiber spread, while requiring comparatively less amount of stretching in each individual band. A reduced number of bands may need to stretch more, in absolute terms, to achieve an equivalent degree of fiber spread.

Figure 1A:
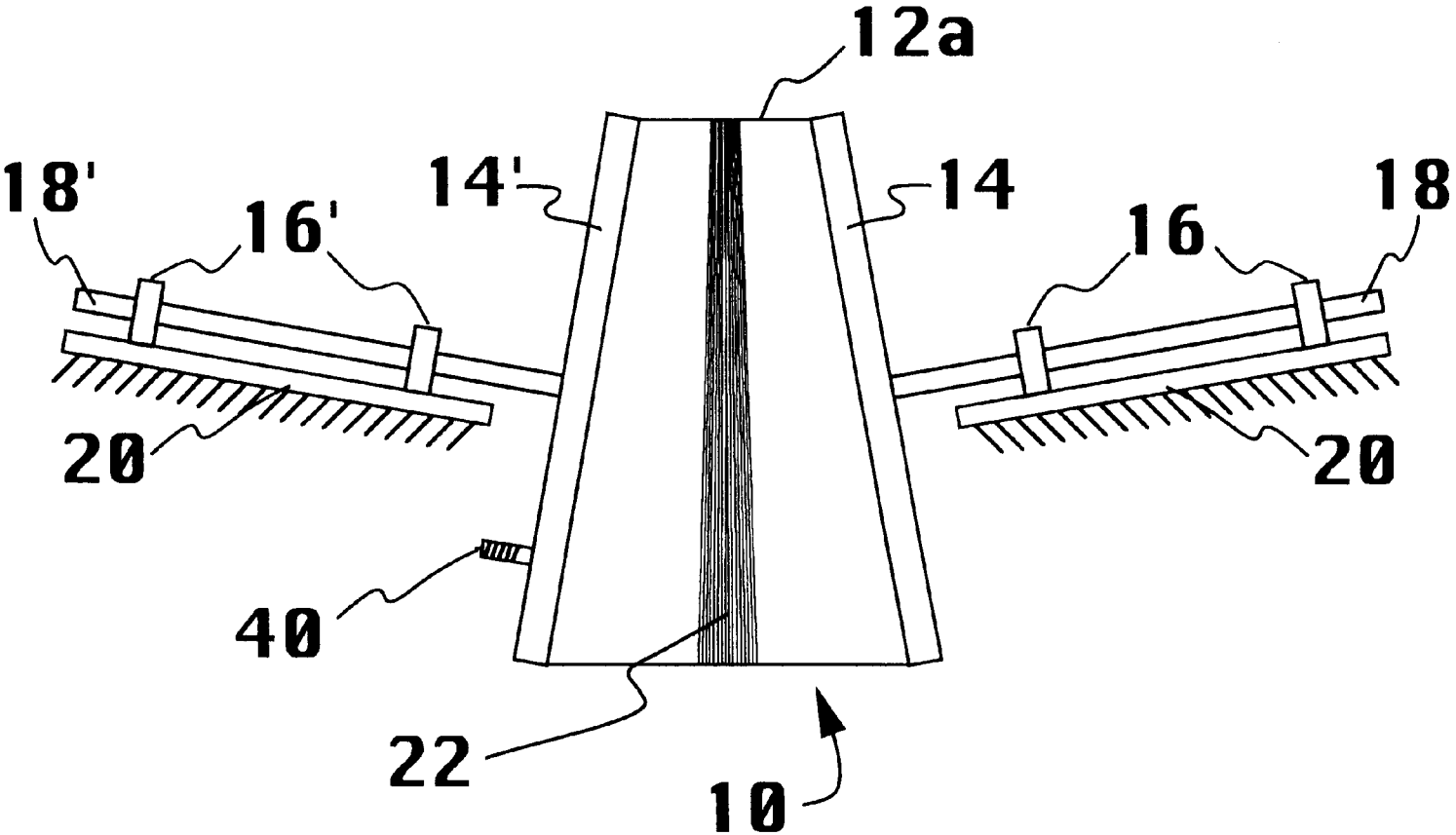
FIG. 1A is a front view of an alternative embodiment of the spreader apparatus according to the invention, showing the inclusion of an expandable tube component and the fiber bundle entering at the top and exiting at the bottom of the figure.

Reference is generally made to a plurality of expandable bands 12 in the foregoing discussion, but alternative embodiments may function in essentially the same way using different elastically expandable members disposed between and connected to the supporting discs 14, 14'. FIG. 1A, for example, illustrates how an elastically expandable tube 12*a* may be extended between the peripheries of the discs 14, 14'. The tube 12*a*, composed of any elastomer fashioned into a thin-walled, generally cylindrical hollow tube, may be stretched between and have its ends connected to the inside faces of the discs 14, 14'. The operation and function of the invention is essentially unchanged, the principal difference being that instead of the "spoked" or cage-like configuration of the elastic bands 12, the tube 12*a* presents an unbroken, continuous working surface to come into contact with the bundle 22. Either the bands 12 or the tube 12*a* can be composed of any expandable material or combination of expandable materials including, but not limited to, natural rubber, synthetic rubber, buna-n, thermoplastic elastomers, and neoprene.

Figure 1B:
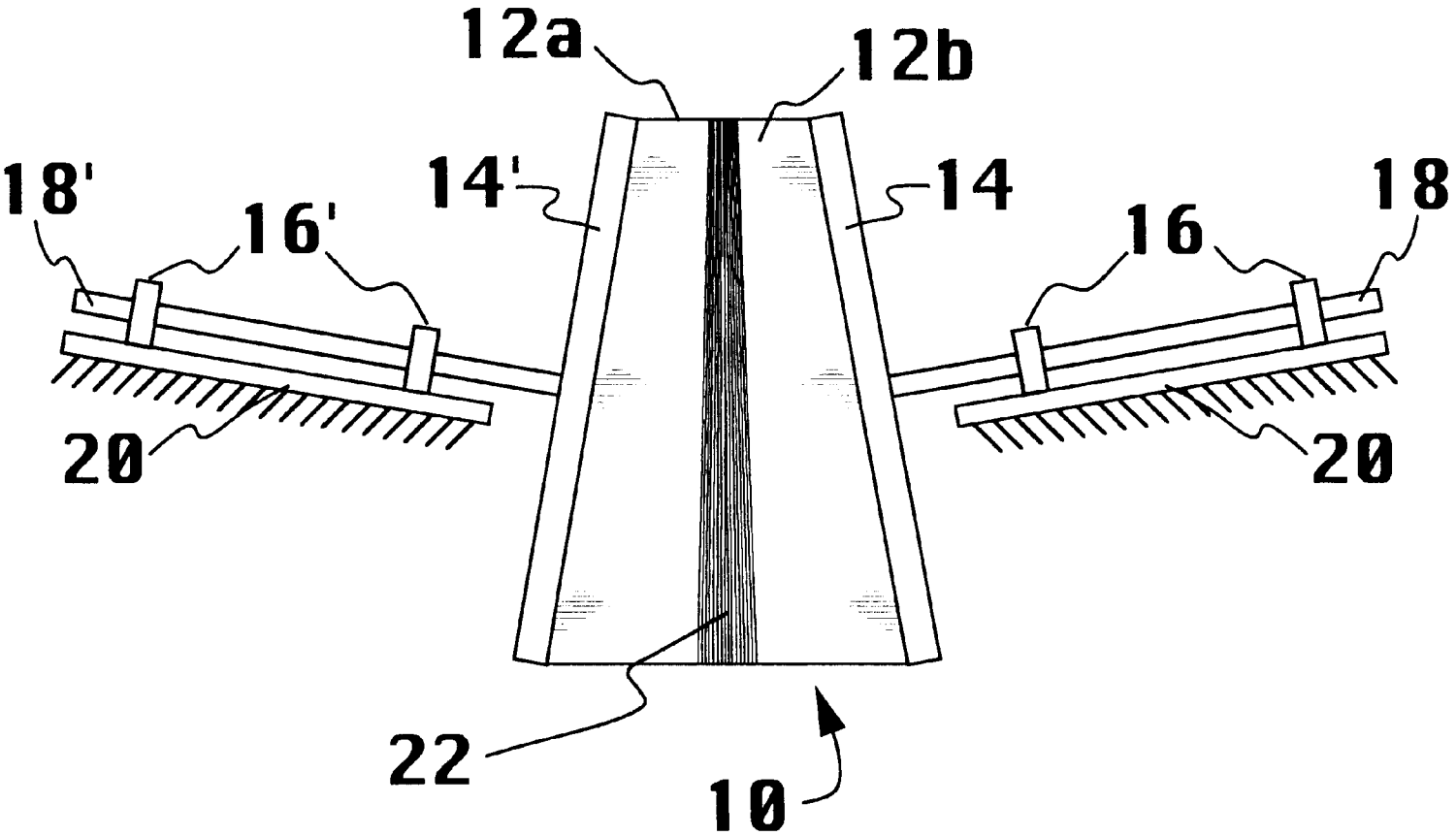
FIG. 1B is a front view of the spreader apparatus according to the invention, showing the inclusion of an elastically expandable and compressible foam insert component within the expandable tube, and the fiber bundle entering at the top and exiting at the bottom of the figure.
Figure 1C:
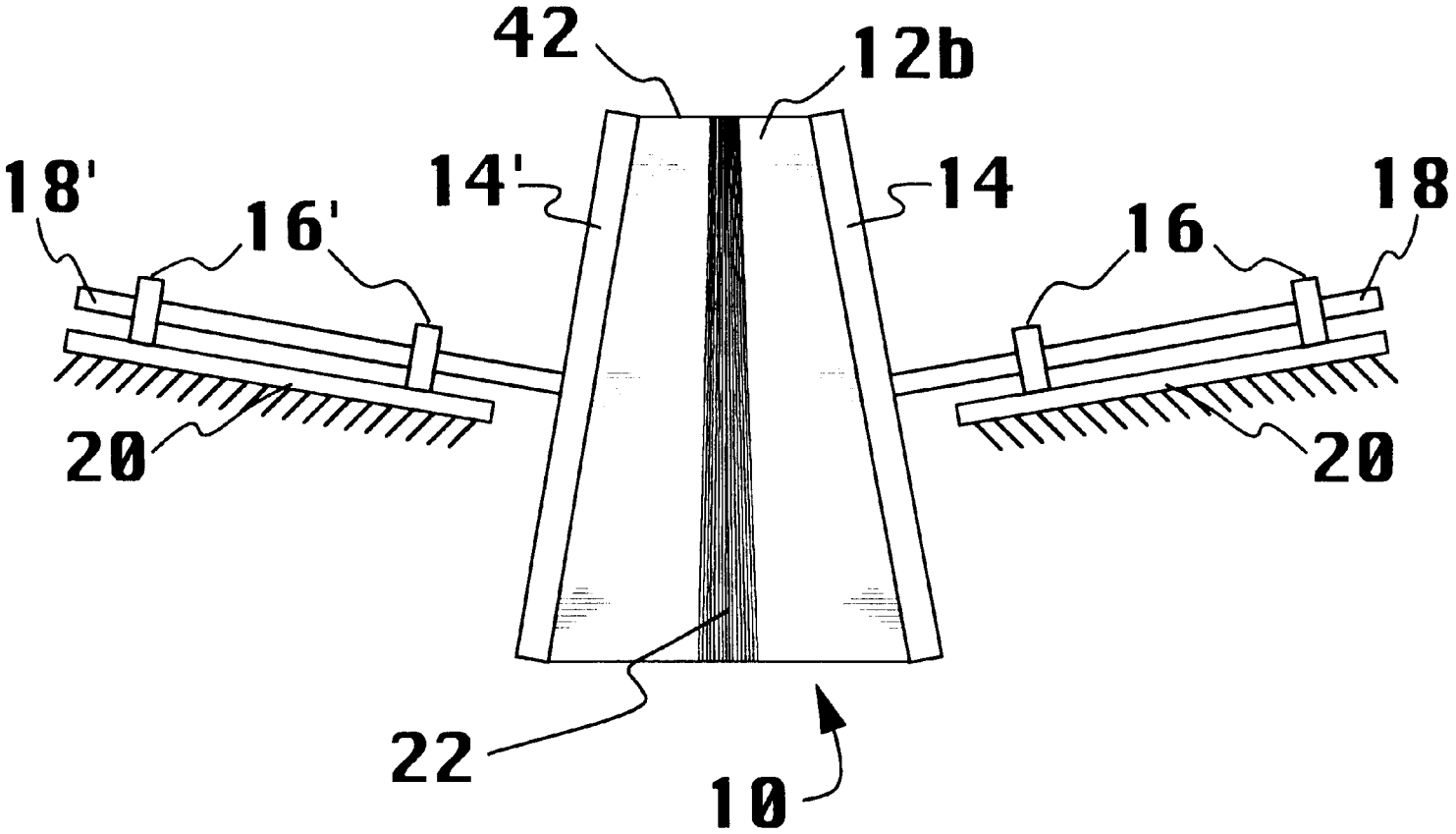
FIG. 1C is a front view of still another alternative embodiment of the invention, showing a foam insert with an optional pliant coating as the expandable member component of the apparatus.

Similarly, the elastically expandable member of the invention may be a solid, compressible, cylindrically shaped piece of foam rubber 12*b* disposed within the interior of the tube 12*a* as indicated in FIG. 1B. The foam can consist of any expandable and compressible material including, but not limited to, polyurethanes, rubbers, and thermoplastic elastomers. The foam rubber insert 12*b* optionally may be provided with a rigid supporting core element of limited diameter extending partially or fully between the precise centers of the discs 14, 14' (inasmuch as the distance between the exact centers of the discs is invariable). In this embodiment, a given radial portion of the foam rubber piece or insert 12*b* periodically expands and contracts as it rotates together with the discs 14, 14'. The function of these alternative embodiments employing an expandable tube 12*a* or a compressible/expandable foam insert 12*b* is essentially the same as the embodiment incorporating a plurality of straps 12. The tube 12*a* may offer the advantage of a continuous surface against which the fiber bundle may be pressed for separation, and the foam insert 12*b* perhaps is more durable. Further, as seen in FIG. 1C, the insert 12*b* may be covered with a pliable coating layer 42 to protect the insert against wear, and to improve the contact between the bundle 22 and the main foam insert 12*b* to boost the efficiency of the separator. In still other embodiments, combinations of expandable bands or an expandable tube with compressible and expandable foams can also be used to help prevent inward collapse or bowing of the expandable bands or expandable tube. Hereinafter, unless otherwise specified, the description of the preferred embodiment also serves to describe the general operation of the alternative embodiments as well.

By angling the support discs 14, 14' with respect to each other, and separating the discs to a desired spacing, the expandable bands 12 are put into tension. The bands 12, tube 12*a*, or foam insert 12*b* preferably remain in constant and continuous tension throughout the operation of the inventive apparatus, although, as explained, the degree of tension varies in proportion to the extent to which the bands are elastically stretched by the varying distance between the discs 14, 14'. As the support discs 14 rotate, each expandable band 12 will stretch from a minimum length to a maximum length. The purpose of the invention is realized by wrapping the fiber bundle 22 partially around the circumference of the expandable portion of the spreader 10, e.g., the plurality of expandable bands 12 while the bands are rotating, and allowing the expansion of the bands to separate, divide, and spread the individual fibers. Thus, the unspread bundle 22 first contacts a relatively unstretched band 12 or an unexpanded section of the tube 12*a* or foam insert 12*b*. As the spreader rotates, the bundle 22 moves with it, while in continuing contact with, and at the same angular velocity as, the expandable section (e.g. bands 12) of the spreader. Being pressed against and frictionally engaged with the expandable bands 12 while the bands revolve around and are stretched to maximum extension, the bundle is separated and individual fibers are pulled therefrom.

Figure 3A:
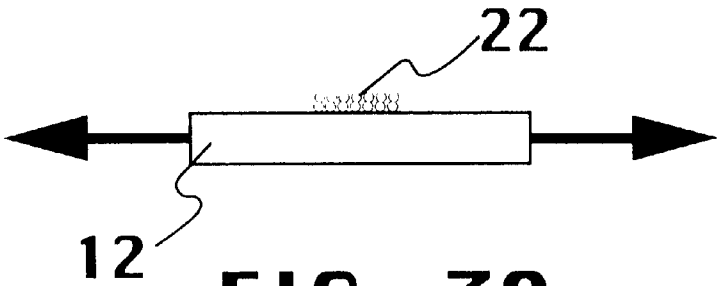
FIGS. 3A–3C show an expandable band element of the invention in various degrees of expansion, illustrating how the spreading function of the invention is achieved with the expandable bands of the embodiment shown in FIGS. 1 and 2, or with an expandable tube, or the elastically compressible foam insert components of the embodiments of FIGS. 1A and 1B respectively.
Figure 3B:
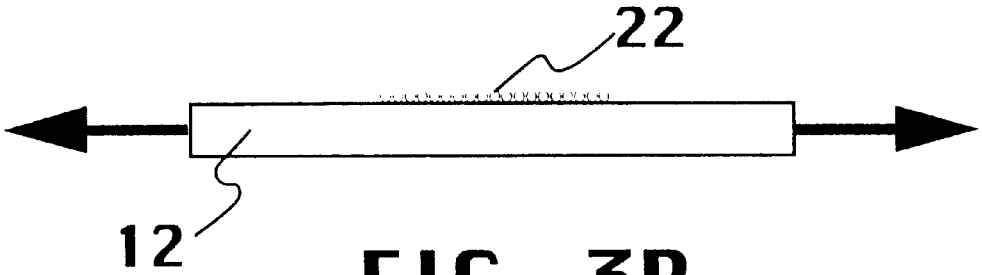
Figure 3C:
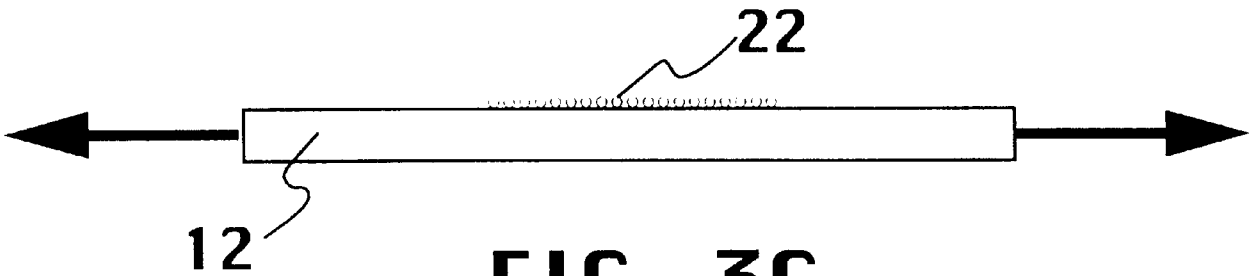

The spreading effect of the function of the invention is illustrated with reference to FIGS. 3A, 3B, and 3C. In FIG. 3A the bundle 22 contacts the band 12 (or the surface of the tube 12*a* or cartridge 12*b*) approximately medially upon the band in its minimally expanded state. As the discs of the apparatus rotate, the band 12 moves to a position extending between a pair of now more widely separated aligned points on the discs, resulting in an elastic axial stretching of the band to a relatively greater length, so that the individual fibers of the bundle are pulled out into the flatter arrangement suggested by FIG. 3B. The band 12 continues to stretch, as indicated by the directional arrows of FIGS. 3A–C, until it has revolved to the location of maximum separation of the discs, with the result that the individual fibers of the bundle are not only pulled into a flatter arrangement, but are separated from one another and spread widely across the medial section of the band 12, as indicated by FIG. 3C. At this juncture, the fibers move away from the band and out of the spreader apparatus. The band 12 continues to revolve, without any bundle or fiber in contact with it, and the band elastically contracts as the distance separating the points of connection of the band to the discs decreases.

In the preferred embodiment, therefore, the incoming fiber bundle 22 enters the fiber spreader 10 and contacts an expandable band 12 while that particular band is at its minimum length (i.e. at the top of the spreader shown in FIGS. 1, 1A, and 1B), and departs from the expandable band 12 while that band is at its maximum length, to then exit the fiber spreader 10 (at its bottom, all as indicated by the directional arrows in FIG. 2). The fiber bundle 22 contacts approximately half of the bands at any given time (or half the circumference of the tube 12*a* or the insert 12*b*), thereby exiting the fiber spreader 10 in the opposite direction that the fiber bundle 22 enters. The constant contact with the bands, tube or foam insert, while it rotates through about half a revolution while expanding, results in the fibers of the bundle being separated such that upon exit from the spreader 10, the bundle has been at least partially spread out into individual fibers. If less than maximum spread is needed, or if process requirements so necessitate, the fiber bundle 22 may be removed from the expandable member, such as the bands 12, at some point before maximum spread of the filaments.

From the foregoing, it is seen that the preferred geometry of the expandable portion of the spreader is cylindrical, i.e., the elastically expandable bands 12 are arranged in a circle, whereby the bands 12 collectively define a cylinder shape. Alternatively, the tube 12*a* or the foam insert 12*b* are cylinder-shaped. In other alternative embodiments the expandable portion of the spreader has other three-dimensional shapes, such as an a rectilinear oblong "box" shape, or an oval tube.

Figure 4:
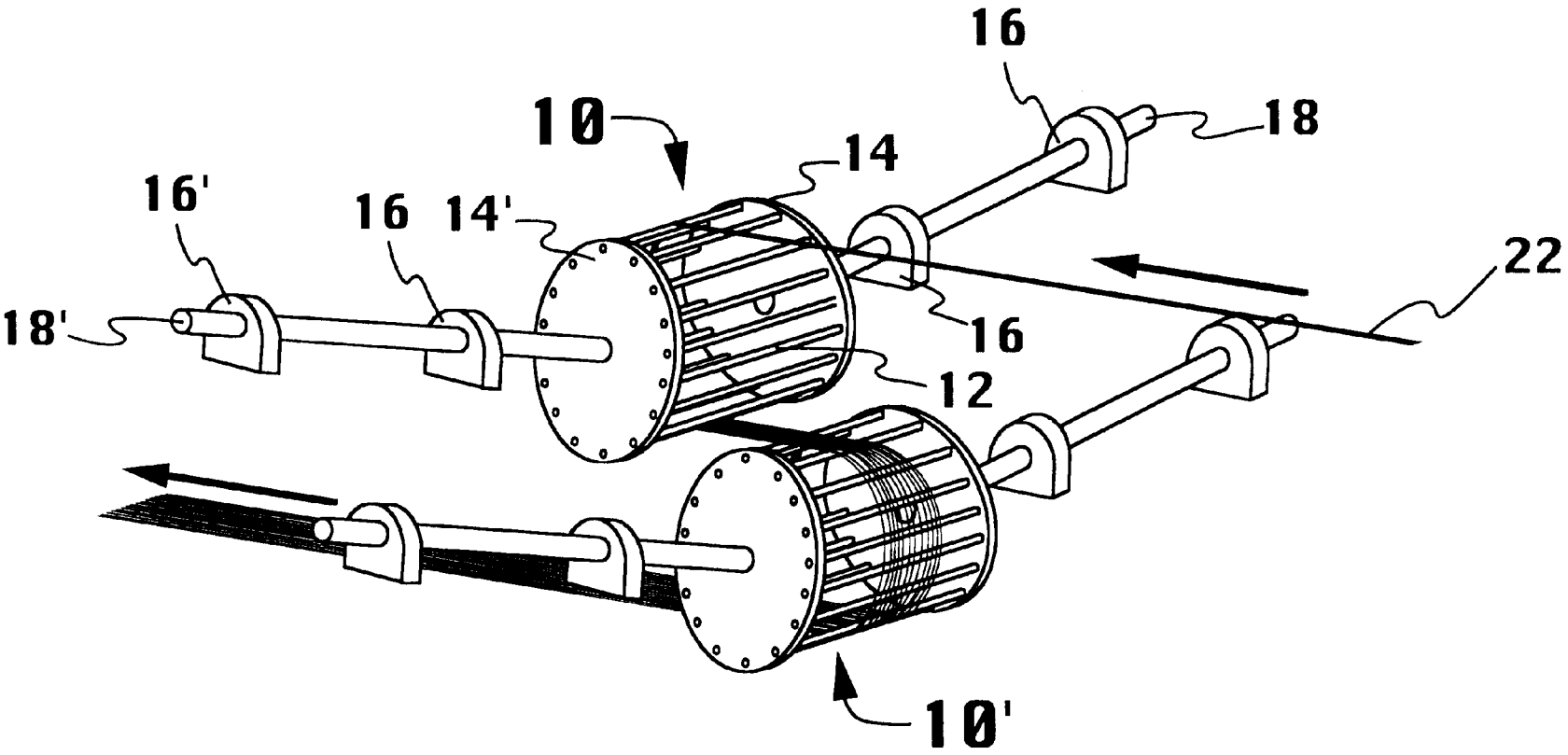
FIG. 4 shows two spreader apparatus according to the embodiment of FIGS. 1 and 2 arranged in series to allow for increased spread and/or change of direction of movement of the fiber bundle.
Figure 5:
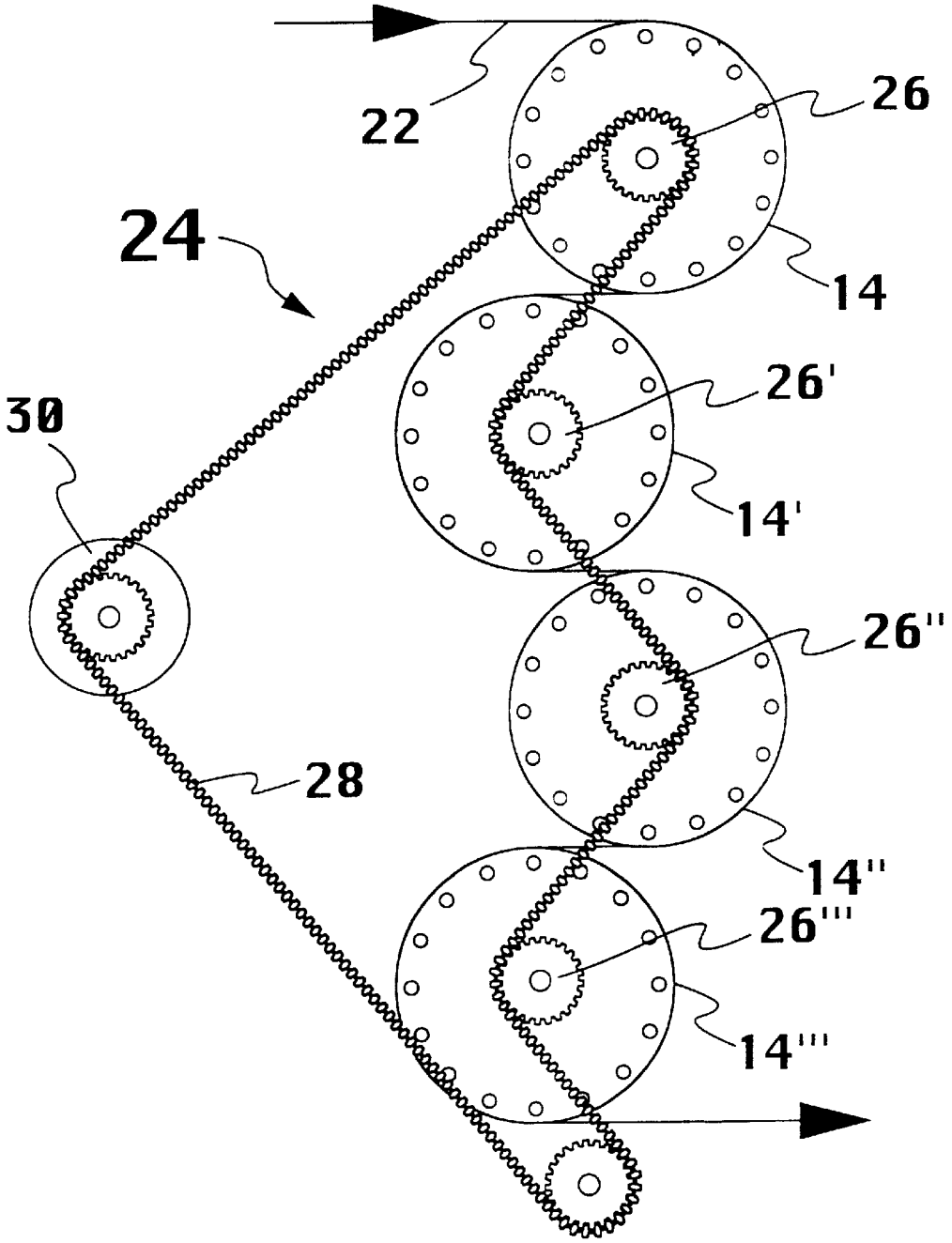
FIG. 5 shows a side view of several spreaders according to the invention, arranged in series and driven by a motor.

Reference is made to FIG. 4. By placing two spreaders 10, 10' close together in parallel relation such that the fiber bundle 22 exiting one fiber spreader 10 then serially enters the second fiber spreader 10', a greater degree of fiber spread is achieved due to the cumulative effect of the two spreaders. The cumulative spreading effect is attributable to the fact that the bundle 22 upon entering the second spreader 10' has already been at least partially flattened, and perhaps partially spread, by the action of the first spreader 10. In such a system of two or more serially operated spreaders, the direction of travel of the fiber tow is reversed, causing the tow to move along its original direction of travel. FIG. 4 shows that the bundle 22 enters the apparatus in a confined and compact configuration, and exists the apparatus as a broader, rather "flat" spread of separated fibers. As indicated by FIG. 5, practically any number of fiber spreaders 10 can be placed in series to achieve increased spreads and changes in travel direction. Thus, the invention optionally includes two or more spreader apparatuses disposed in parallel, where the bundle is wrapped at least partially around the respective elastically expandable members of the spreaders, so that when the members are rotated, the bundle moves serially through the two or more apparatuses.

A fiber spreader 10 can be fabricated such that it is free spinning or motor driven. In a free-spinning embodiment, the spreader is operated and the discs rotated by the movement of the tow bundle itself. The tow is wrapped at least partially around the elastically expandable member of the apparatus, such as some of the bands 12. The friction between the tow and the bands 12 is sufficient that when the tow 22 is pulled through the spreader (see directional arrows in FIG. 2), the tow itself serves to rotate the spreader 10. The tow is pulled by a powered spool or the like (not shown in the drawings), so that it is drawn toward the spool (as suggested by the directional arrows of FIGS. 2 and 4). The frictional engagement of the fibers with the expandable portion of the spreader 10 imparts movement to the spreader, as the powered linear movement of the tow 22 is converted to rotational movement of the spreader about which the tow is wrapped. Without an integral drive system, the tension in the expandable bands 12 are adjusted so that the bands expand and contract almost entirely axially, with relatively little lateral displacement due to the action of the tow 22, and preferably entirely within their linear range of functional response (i.e., within the range of stretching where the conventional spring formula F=kx applies). The increased force required to stretch a band 12 from its minimum length to its maximum length is offset by the decreased force in the radially opposite band as it decreases in length. This allows for relatively free spinning of the support discs 14, 14' while maintaining the discs in their proper obliquely skewed relationship.

Alternatively, the inventive spreader 10 can include a drive system. By using a driven system 24 as shown in FIG. 5, the expandable bands 12 can be stretched further, and do not need to operate mainly within their linear range of response. Greater stretching eliminates the need for the fiber bundle 22 to spin the fiber spreader 10. As seen in FIG. 5, the drive system can consist of gears or pulleys 26, 26', 26", 26'" attached to the outside faces of respective support discs 14, 14', 14", 14'", a belt or chain 28, and a drive motor 30 engaging the drive chain 28 and preferably capable of variable speeds.

As explained, as the support discs 14, 14' rotate, each of the expandable bands 12 goes through a cycle, taking them from their minimum lengths to maximum lengths. As each expandable band 12 increases in length, a portion of the fiber bundle 22 in contact with the expandable band 12 will spread apart. The amount of spread is dictated by several factors including:

1) The angles of the support discs 14, 14'. The greater the angle between the support discs 14, 14' of a given diameter, the greater the incremental stretch to which each expandable band 12 will be subjected.
2) The distance between the support discs 14, 14'. Support discs 14, 14' at the same angle, but separated further apart, impart less overall stretch to the expandable bands 12 than support discs placed comparatively closer together.
3) The initial width of the incoming fiber bundle 22.
4) The diameter of the circle defined by the expandable bands 12. The larger the diameter, the greater the stretch to which each expandable band 12 will be subjected for a given angle between discs 14, 14'.

In the preferred embodiment, the amount of expansion or elongation the expandable member undergoes during each cycle is adjustable. The user can select the degree of elongation or expansion to adapt the apparatus to the particular type or composition of fiber bundle being spread, or to suit the rate at which the bundle is being fed to and withdrawn from the apparatus.

Figure 6:
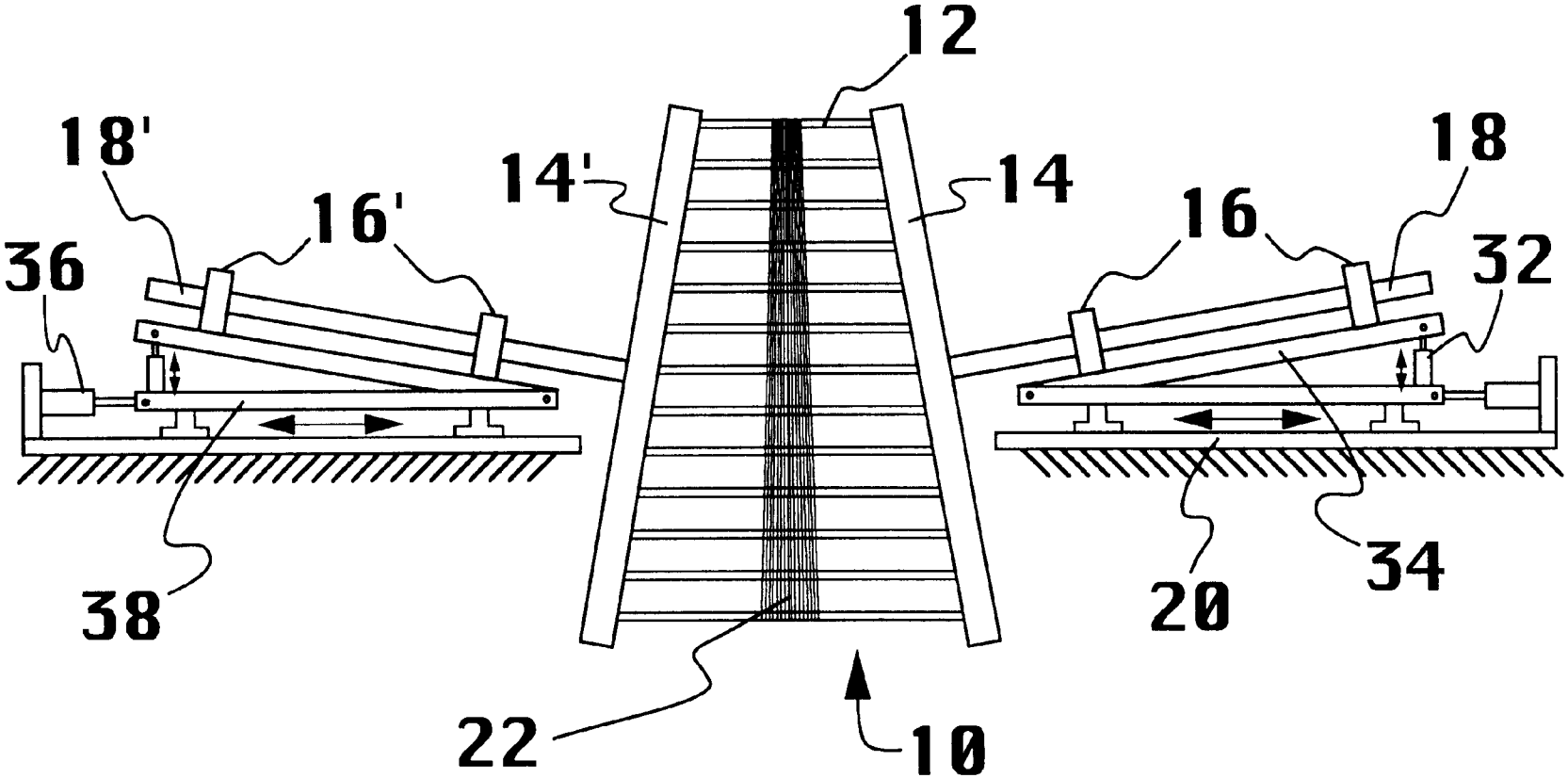
FIG. 6 depicts another alternative embodiment of the apparatus according to the invention, specifically an adjustable spreader allowing for an increased or decreased degree of fiber spreading, and the ability to accommodate wider fiber bundles entering the spreader.

The fiber spreader 10 can be adjustable as shown in FIG. 6. For example, a generally vertically disposed linear actuator 32 attached to a pivotal mount 34 can be used to change the angle of a support disc 14. The bearings 16 are attached to the mount 34, thereby connecting the shaft 18 to the pivotal mount 34. The actuator 32, which may be hydraulically driven (e.g. up and down, is indicated by directional arrows in FIG. 6), is controlled to tilt the corresponding shaft 18 and thus adjust the positional angle of the disc 14 to serve as means for controllably adjusting the oblique angle. The absolute distance of separation between the support discs 14, 14' can similarly be adjusted using a horizontal actuator 36 and movable slide 38. In the preferred embodiment, the pivotal mount 34 is connected to the slide 38 so that both the angular disposition and the separation distance of the discs 14, 14' may be adjusted. (In one embodiment the bearings 16 and shaft 18 are attached directly to the slide 38 to permit adjustment only of the separation distance.) The horizontal actuator 36 may be hydraulically, pneumatically, electrically, or manually driven to cause the slide 38, which is slidably connected to the support structure 20, to move (back and forth from side-to-side, as indicated by the directional arrows in FIG. 6). Movement of the slide 38 controllably adjusts the separation distance between the discs 14, 14', and the slide and its actuator thus serve as one possible means for adjusting the absolute distance separating the discs.

Adjusting the angles and the separation distance of the support discs 14, 14' permits adjustments to be made to the rate and extent of fiber bundle spread. Certain fragile fibers, for example, may be separated more slowly using a reduced degree of support disc angular orientation—which also reduces the extent of the spread.

Attention is returned to FIG. 1A. If an expandable tube 12*a* is used rather than expandable bands, the tube can be mounted to the support discs 14 such that a seal is created between the tube and the discs 14, 14'. An compressed air fitting or valve 40 may be provided through one of the support discs 14' to allow for controlled adjustment of the pressurization of the expandable tube 12*a*. By connecting the fitting 40 to a source of compressed air or other gas (not shown), the pressure within the tube 12*a* can be adjusted to control the expandability/contractability of the tube during operation of the invention. Adjustments to the pressure within the tube 12*a* may be used to manipulate the performance characteristics of the tube, and to prevent collapse of the tube near its middle section.

Other methods can also be used to prevent collapse of the tube 12*a*. For example, an expandable and compressible piece of foam 12*b* can be placed inside the expandable tube 12*a* to help support the inner surface of the expandable tube as shown in FIG. 1B, thereby eliminating the need for pressurized air. Foams such as polyurethanes exhibit the necessary properties to provide such support, and have the ability to expand and contract as the support discs rotate. In a similar fashion, if desired, a foam insert can be disposed within the cylinder shape defined by the bands 12 to provide added control or support to the expansion and contraction of the bands themselves.

An expandable and compressible piece of foam 12*b* can also be used in place of expandable bands and an expandable tube as shown in FIG. 1C. The foam insert 12*b* is attached directly to the support discs 14, and as the support discs rotate, the section of foam in contact with the fiber bundle will expand, thereby imparting separation of the fiber bundle 22. The outer surface of the foam can be coated with a pliable material 42, such as polyurethane, to minimize damage to delicate fiber bundles. Other options for the pliable protective outer coating include, but are not limited to rubbers, latexes, and thermoplastic elastomers.

The fiber spreader 10 can be fabricated from a variety of materials. The expandable bands 12 or expandable tube 12*a* can be made of any expandable material that is compatible with the fiber bundle 22. Examples include natural and synthetic rubber, latex, and thermoplastic elastomers. If foam insert 12*b* is used in place of expandable bands, or to support an expandable tube, it can be made from a variety of materials including, but not limited to polyurethanes, rubbers, and thermoplastic elastomers.

Various methods can be used to support the expandable bands 12, expandable tube 12*a*, or compressible and expandable foam insert 12*b*, and various materials can be used for the support discs 14. The discs can, for example, be fashioned from virtually any structural material or combination of structural materials including, but not limited to steel, aluminum, plastics, wood, and composites.

Other known equivalents can also be used to drive the fiber spreader 10 or a series of fiber spreaders 10, and to adjust the angles or separation distance of the support discs.

The invention may be practiced to spread fiber bundles composed of a wide variety of materials fiber bundles, such as inorganic, metallic, ceramic, polymeric, or refractory fibers such as but not limited to carbon, glass, quartz, polyethylene, poly(paraphenylene terephthalamide), silicon carbide, and boron nitride. An advantage of the invention is that it may be practiced upon one or more fiber bundles that are spread to produce a thin collimated fiber tape. Also, by the invention a fiber bundle may be spread so that it can be impregnated with thermoplastic or thermoset powder, a polymer solution, or a melted polymer film to form a composite tape. Or, the fiber bundle may be spread to produce a fiber reinforced metallic or ceramic body.

The method of the invention is evident from the foregoing. The steps of the inventive process include disposing an elastically expandable member between a pair of support discs, disposing the discs at oblique angles to each other, rotating the discs and the elastically expandable member, wrapping a fiber bundle at least partially around the rotating expandable member, and allowing the expansion of the expandable member to spread the fibers of the bundles while feeding the bundle to the medial portion of the member and withdrawing the spread individual fibers from the medial portion of the component. Additional steps include adjusting the distance of separation between the discs, and adjusting the angle of tilt of the discs with respect to each other. The method optionally also includes providing at least two pairs of discs with an elastically expandable member disposed there between and arranging a plurality of such pairs in a series.

INDUSTRIAL APPLICABILITY

The invention is further illustrated by the following non-limiting examples.

EXAMPLE 1

An unsized carbon fiber bundle 22 with 12,000 individual filaments, also known as a 12K tow, was pulled through a series of two fiber spreaders 10 with a take-up winder. A creel was used to support the carbon fiber spool and maintain a relatively low back-tension. The fiber spreaders were not motor-driven and relied on the friction of the 12K tow to spin the spreaders. Each fiber spreader consisted of 24 expandable bands 12 evenly spaced around a 3.5 inch diameter circle. The expandable bands were made of latex, with an inside diameter of 0.125 inches and an outside diameter of 0.25 inches. Support discs 14, 14', fabricated from polycarbonate, were used to support the bands. The support discs were angled away from each other at approximately 8.2 degrees from vertical. The support discs were spaced approximately 1.5 inches apart at their midpoint such that each expandable band increased in length from 1 inch to 2 inches. The bands were given an initial pre-stretch before attaching them to the support discs so that they stretched primarily axially in their linear expansion region. The 12K tow leading into the first fiber spreader had a width of approximately 0.25 inches.

The 12K tow entered the first spreader near the top and exited at the bottom, contacting approximately 13 of the expandable bands at any one time. Friction from the 12K tow caused the fiber spreader to rotate. As the fiber spreader rotated the incoming 12K tow spread from approximately 0.25 inches to 0.5 inches. As the 12K tow exited the first spreader it was traveling in an opposite direction to the incoming direction. Upon leaving the first fiber spreader, the 12K tow was then fed into a second fiber spreader. The second spreader increased the spread of the incoming 12K tow from 0.5 inches to 1 inch. The spread 12K tow was then traveling along its original direction of travel and continued on to a powder coating process whereby the 12K tow was impregnated with a nylon powder. The coated 12K tow was then passed through a furnace, to melt the powder and form a prepreg. Once it left the furnace, it was passed through a cooling process and wound onto a take-up winder. The 12K tow was pulled through the process at a speed of 300 ft/min.

EXAMPLE 2

An unsized carbon fiber bundle with 48,000 individual filaments, also known as a 48K tow, was pulled through a process whereby the tow was spread and then dipped into a solution that consisted of a polymeric matrix material dissolved in a solvent. At the beginning of the process, the fiber bundle was pulled from a creel and passed through a series of four fiber spreaders that were motor-driven. A single motor was used to drive a series of pulleys connected to each spreader by a single belt. The motor was variable speed and adjusted such that the speed of the 48K tow was 30 ft/min. Each of the fiber spreaders consisted of 24 expandable latex bands evenly spaced around a 3.5 inch diameter circle. The support discs, fabricated from polycarbonate, were angled away from each other at approximately. 8.2 degrees from vertical. The spacing of the support discs at their center points for each of the fiber spreaders was as follows:

Spreader 1: 1.5 inches

Spreader 2: 1.75 inches

Spreader 3: 2.75 inches

Spreader 4: 4.0 inches

The increased spacing was necessary to accommodate the width of the 48K tow as it passed from one spreader to the next. The 48K tow leading into fiber spreader 1 had a width of approximately 0.5 inches. The first spreader increased the width of the incoming 48K tow from approximately 0.5 inches to 1.0 inches.

As the 48K tow serpentined through the next three fiber spreaders, the spread was increased from approximately 1.0 inches to 1.8 inches, 1.8 inches to 2.6 inches, and 2.6 inches to 3.4 inches. The spread 48K tow continued traveling along its original direction of travel and on to a solution coating process. The solution coating consisted of a polymeric matrix material dissolved in a solvent. The spread 48K tow was passed over a flat roller, beneath two flat rollers submerged within the solution bath, and then back over another flat roller. The tow was then passed through a furnace at 200° C. to evaporate the solvent and produce a tape. The tape was wound onto a spool by means of a take-up winder.

EXAMPLE 3

Several spreading systems, as described in example 2, are placed side-by-side and have 48K tows passing through them. After leaving their respective spreaders, the tows are passed over a single roller and brought together such that the sides of each spread tow touch. The tows are then dipped into a solution consisting of a polymeric matrix material dissolved in a solvent or coated with a hot melt polymeric film to form a thin, low areal density prepreg tape. The collimated tape is then wound onto a spool by means of a take-up winder for subsequent manufacture of lightweight composites such as space structures and sporting goods.

The preceding examples can be repeated with similar success by substituting the generically or specifically described reactants and/or operating conditions of this invention for those used in the preceding examples.

Although the invention has been described in detail with particular reference to those preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus for spreading the individual fibers of a fiber bundle, comprising:

at least one elastically expandable member rotatably mounted upon a support; and means for periodically expanding and contracting a portion of said elastically expandable member;

wherein when the fiber bundle is frictionally wrapped at least partially around said at least one elastically expandable member to engage said portion, and when said member is rotated, individual fibers of the bundle are spread by the expansion of said portion of said expandable member.

2. An apparatus according to claim 1 comprising at least two said apparatus disposed in parallel, wherein the bundle is wrapped at least partially around at least two elastically expandable members, and when said members are rotated, said bundle moves serially through said at least two apparatuses.

3. An apparatus according to claim 1 further comprising a pair of support discs, one of each said discs attached to a respective end of said expandable member.

4. An apparatus according to claim 3 wherein said support discs are disposed at an oblique angle so that the distance separating said discs varies, and wherein the rotation of said discs alternately increases and decreases the separation distance between a point on a periphery of one of said discs and the periphery of the other disc.

5. An apparatus according to claim 4 wherein said discs are substantially circular, and said elastically expandable member defines a generally cylindrical shape.

6. An apparatus according to claim 4 wherein said elastically expandable member comprises a plurality of elastic bands.

7. An apparatus according to claim 6 wherein said bands are uniformly spaced apart and disposed between said peripheries of said support discs.

8. An apparatus according to claim 5 wherein said elastically expandable member comprises an elastic tube.

9. An apparatus according to claim 8 further comprising a fitting in one of said support discs for adjusting gas pressure within said elastic tube.

10. An apparatus according to claim 8 further comprising an expandable and compressible foam insert disposed within said elastic tube.

11. An apparatus according to claim 5 wherein said elastically expandable member comprises an elastically expandable foam insert.

12. An apparatus according to claim 4 further comprising means for controllably adjusting said oblique angle.

13. An apparatus according to claim 4 further comprising means for adjusting the absolute distance separating said discs.

14. An apparatus according to claim 4 further comprising means for powered rotation of at least one of said discs.

15. An apparatus for spreading the individual fibers of a fiber bundle, comprising:

at least one pair of rotatable support discs disposed at oblique angles to one another; and an elastically expandable member disposed between and connected to said pair of support discs;

wherein when the fiber bundle is frictionally wrapped at least partially around said elastically expandable member to engage said portion, and when said member is rotated, individual fibers of the bundle are spread by the expansion of said portion of said expandable member.

16. An apparatus according to claim 15 wherein said discs are substantially circular, and said elastically expandable member defines a generally cylindrical shape.

17. An apparatus according to claim 15 wherein said elastically expandable member comprises a plurality of elastic bands.

18. An apparatus according to claim 17 wherein said bands are uniformly spaced apart and disposed between said peripheries of said support discs.

19. An apparatus according to claim 15 wherein said elastically expandable member comprises an elastic tube.

20. An apparatus according to claim 19 further comprising a fitting in one of said support discs for adjusting gas pressure within said elastic tube.

21. An apparatus according to claim 19 further comprising an expandable and compressible foam insert disposed within said elastic tube.

22. An apparatus according to claim 15 wherein said elastically expandable member comprises an elastically expandable foam insert.

23. An apparatus according to claim 15 further comprising means for controllably adjusting said oblique angles.

24. An apparatus according to claim 15 further comprising means for adjusting the distance separating said discs.

25. An apparatus according to claim 15 comprising at least two said apparatus disposed in parallel, wherein the bundle is wrapped at least partially around at least two elastically expandable members, and when said members are rotated, said bundle moves serially through said at least two apparatuses.

26. A method for spreading the individual fibers of a fiber bundle, comprising the steps of:

frictionally wrapping the fiber bundle at least partially around at least one elastically expandable member to engage the portion of the member;

rotating the at least one elastically expandable member; and periodically expanding and contracting a portion of the elastically expandable member;

wherein when the member is rotated, individual fibers of the bundle are spread by the expansion of the portion of the expandable member.

27. A method according to claim 26 further comprising the steps of:

attaching a support disc to each end of said expandable member; and disposing the discs at an oblique angle so that the distance separating the discs varies, and wherein rotating the expandable member alternately increases and decreases the separation distance between a point on a periphery of one of the discs and the periphery of the other disc.

28. A method according to claim 26 wherein the step of rotating the at least one elastically expandable member comprises disposing in a cylindrical array a plurality of elastic bands, and rotating the cylindrical array generally about its axis.

* * * * *